United States Patent [19]

Martinmaas

[11] 4,352,307

[45] Oct. 5, 1982

[54] SOCKET WRENCH WITH INTERCHANGEABLE SOCKETS STORED IN HANDLE

[76] Inventor: Werner W. Martinmaas, 3461 Cashill Blvd., Reno, Nev. 89509

[21] Appl. No.: 284,953

[22] Filed: Jul. 20, 1981

[51] Int. Cl.[3] ..... B25G 1/08

[52] U.S. Cl. ..... 81/177 N; 145/62; 206/378

[58] Field of Search ..... 16/110.5; 81/177 R, 81/177 E, 177 G, 177 M, 177 N, 180 R; 145/61 R, 61 J, 62; 206/375, 378, 559, 560; 220/20, 22

[56] References Cited

U.S. PATENT DOCUMENTS

| | | | |
|---|---|---|---|
| 1,289,558 | 12/1918 | Sedgley | 81/177 N X |
| 1,361,824 | 12/1920 | Bugbee | 206/559 |
| 1,680,578 | 8/1928 | Wakefield | 206/375 |
| 1,724,491 | 8/1929 | Mandl | 81/177 G X |
| 1,961,450 | 6/1934 | Petersen | 206/375 |
| 2,301,945 | 11/1942 | Green | 81/124.1 |
| 2,776,589 | 1/1957 | Gregory | 81/177 N |
| 3,745,860 | 7/1973 | Bennett | 81/177 N X |
| 4,253,356 | 3/1981 | Martinmaas | 81/177 N |

FOREIGN PATENT DOCUMENTS

| | | | |
|---|---|---|---|
| 1504865 | 3/1978 | United Kingdom | 145/62 |

*Primary Examiner*—James G. Smith

*Attorney, Agent, or Firm*—Wegner, McCord, Wood & Dalton

[57] ABSTRACT

Socket member storage means for a set of interchangeable sockets of a socket wrench has a longitudinal wall defining a long, narrow storage cavity which has an entrance opening along one side and which is divided into several distinct portions, each of which receives one socket member of a set. A resilient member in each portion of the storage cavity frictionally grips and retains one socket member, and each of the resilient members has an extremity projecting above a side of the wall by means of which it may be flexed outwardly to release the one socket member for removal from the storage cavity independently of any other socket member. Preferably the longitudinal wall provides the handle of the wrench.

6 Claims, 2 Drawing Figures

SOCKET WRENCH WITH INTERCHANGEABLE SOCKETS STORED IN HANDLE

BACKGROUND OF THE INVENTION

Applicant's U.S. Pat. No. 4,253,356 discloses a socket wrench structure which includes socket member storage means of the same general type disclosed in the present application.

For reasons stated in the specification of U.S. Pat. No. 4,253,356, the type of socket wrench there disclosed reduces the possibility that sockets will be misplaced, and eliminates the problem of getting into a job in which a socket wrench is required and then discovering the sockets needed for the job are not at hand.

SUMMARY OF THE INVENTION

The principal object of the present invention is to provide a socket storage means of the general type disclosed in U.S. Pat. No. 4,253,356, but in which the access openings of that device are eliminated.

In accordance with the present invention, socket member storage means comprises a longitudinal wall defining a long, narrow storage cavity which has an entrance opening along one side, and the storage cavity has several distinct portions along its length, each of which receives one socket member of a set. A resilient member in each such portion of the storage cavity extends more than half way around the socket member in the portion so as to frictionally grip and retain the socket member in the storage cavity, and each of the resilient members has an extremity projecting above one side of the longitudinal wall. The extremity is adapted to be flexed outwardly to release the socket member for removal from the storage cavity independently of any other socket member.

THE DRAWINGS

FIG. 1 is a perspective view of a socket wrench embodying the present invention; and FIG. 2 is a transverse sectional view on an enlarged scale taken substantially as indicated along the line 2—2 of FIG. 1, with a flexible member illustrated in its flexed position in broken lines.

DETAILED DESCRIPTION OF THE INVENTION

Figure 1:
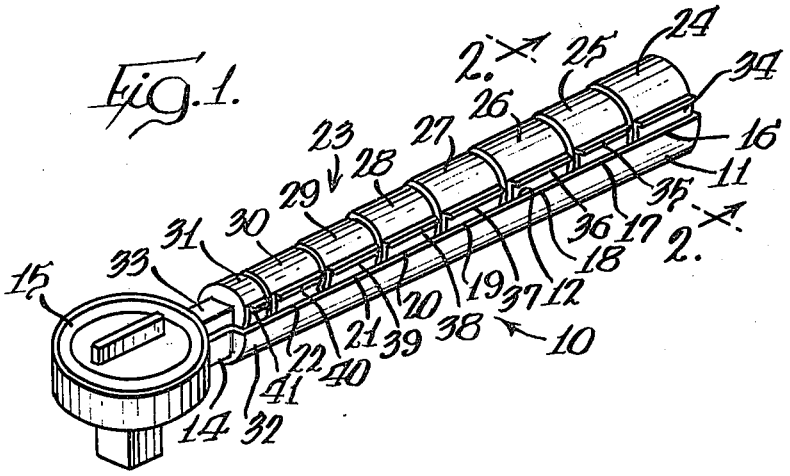

Referring to the drawings in detail, socket member storage means for a socket wrench, indicated generally at 10, includes a longitudinal wall 11 which defines a long, narrow storage cavity 12, one side of which is open to provide an entrance opening 13. In the disclosed embodiment the wall 11 is integrally connected by a neck 14 with a wrench head 15 so as to provide a handle for the wrench. The storage cavity has several distinct portions along its length, numbered 16 through 22; and a set of socket members, indicated generally at 23, has its individual socket members 24 through 30, stored, respectively, in the storage cavity portions 16 through 22. An extension member 31 is also received in a forwardmost portion 32 of the storage cavity and has a stub 33 that seats in the neck 14 of the wrench.

Figure 2:
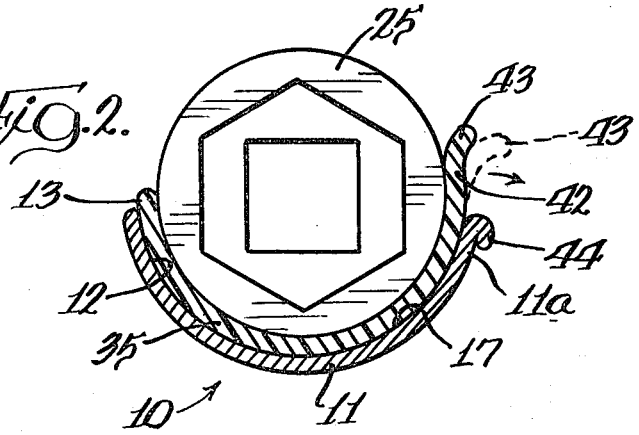

The portions 16 through 22 and 32 of the storage cavity are provided with respective resilient members 34 through 41, all of which fit into the respective storage cavity portions in the manner illustrated in FIG. 2 for the resilient member 35. Each of the resilient members is like the resilient member 35 in that it is bonded to the interior of the wall 11 and spans an arc slightly in excess of 180° so as to extend more than halfway around the socket member and frictionally grip and retain the socket member in the storage cavity as is illustrated for the resilient member 35 and socket member 25 in FIG. 2.

Each of the resilient members has an extremity like the extremity 42 of the resilient member 35 which projects above one side 11*a* of the wall, and each of the extremities is adapted to be flexed outwardly as illustrated in broken lines in FIG. 2 to release the socket member for removal from the storage cavity independently of any other socket member. To facilitate manipulation of the resilient members, each of the extremities terminates in a laterally projecting finger piece such as the finger piece 43 illustrated in FIG. 2. Furthermore, as seen in FIG. 2 the side 11*a* of the side wall has a laterally projecting, rounded longitudinal rib 44 beneath the line of finger pieces of the resilient members 34 through 41; and the top margin of the side 11*a* provides a fulcrum about which the projecting extremity of each resilient member may swing outwardly.

Each of the resilient members preferably is molded from a suitable plastic material, and said members have rounded extremities, both to eliminate sharp edges and to facilitate insertion of the socket members into them.

The foregoing detailed description is given for clearness of understanding only and no unnecessary limitations should be understood therefrom, as modifications will be obvious to those skilled in the art.

I claim:

1. Socket member storage means for a set of interchangeable sockets of a socket wrench of the type which has a head with a socket mounting stub, said storage means comprising:

a longitudinal wall defining a long, narrow storage cavity which has an entrance opening along one side, said storage cavity having several distinct portions along its length each of which receives one socket member of a set;

and a resilient member in each such portion which extends more than half-way around the socket member in said portion so as to frictionally grip and retain the socket member in the storage cavity, each said resilient member having an extremity projecting above one side of the wall, said extremity being adapted to be flexed outwardly to release the socket member for removal from the storage cavity independently of any other socket member.

2. The storage means of claim 1 in which said extremity of each resilient member terminates in a laterally projecting finger piece to facilitate outward flexing thereof.

3. The storage means of claim 2 in which said one side of the wall provides a fulcrum about which the projecting extremity of the resilient member may swing outwardly.

4. The storage means of claim 1 in which said one side of the wall provides a fulcrum about which the projecting extremity of the resilient member may swing outwardly.

5. The storage means of claim 1 in which said one side of the wall has a laterally projecting, rounded longitudinal rib beneath said extremity of the resilient member.

6. The storage means of any of the preceding claims in which the longitudinal wall is integrally connected to the head and provides a handle for the wrench.

* * * * *